US006725641B2

(12) United States Patent
Lefebvre

(10) Patent No.: US 6,725,641 B2
(45) Date of Patent: Apr. 27, 2004

(54) METHOD OF MANUFACTURING A REINFORCING THREAD

(75) Inventor: Jean Lefebvre, Estree Mons (FR)

(73) Assignee: Lainiere de Picardie BC, Peronne (FR)

( * ) Notice: Subject to any disclaimer, the term of this patent is extended or adjusted under 35 U.S.C. 154(b) by 121 days.

(21) Appl. No.: 09/919,905

(22) Filed: Aug. 2, 2001

(65) Prior Publication Data

US 2002/0014066 A1 Feb. 7, 2002

(30) Foreign Application Priority Data

Aug. 4, 2000 (FR) ..... 00 10354

(51) Int. Cl.[7] ..... D01H 4/16
(52) U.S. Cl. ..... 57/401; 57/224
(58) Field of Search ..... 57/5, 315, 331, 57/334, 335, 401, 224

(56) References Cited

U.S. PATENT DOCUMENTS 4,209,965 A 7/1980 Bobkowicz
4,359,856 A 11/1982 Bobkowicz
5,414,984 A 5/1995 Groshens et al.

OTHER PUBLICATIONS

French Preliminary Search Report.

*Primary Examiner*—John J. Calvert
*Assistant Examiner*—Shaun R Hurley
(74) *Attorney, Agent, or Firm*—Blank Rome LLP

(57) ABSTRACT

The invention is a method of manufacturing, by friction spinning, a reinforcing thread (1) for fabric covering or a technical textile intended to be incorporated in a textile base, in which:

the spinning machine (7) is supplied with a core thread (2);

and simultaneously with a silver (9) of fibers (3, 4), the fibers (3, 4) being individualised and then associated with the said core thread (2).

The silver (9) of fibers is formed from a mixture of hot-melt fibers (3) and high melting point fibers (4).

26 Claims, 1 Drawing Sheet

METHOD OF MANUFACTURING A REINFORCING THREAD

FIELD OF THE INVENTION

The invention concerns a method of manufacturing, by friction spinning, a reinforcing thread for a fabric covering or technical textile. Throughout the specification and claims, the word "thread" will be used in its broad meaning, encompassing yarns, rather than in its more restrictive meaning.

The invention concerns a method of manufacturing, by friction spinning, a reinforcing thread for a fabric covering or technical textile.

DESCRIPTION OF RELATED ART

Such threads are intended to be woven or to be incorporated in a textile base, for example formed by a knitted fabric.

They are frequently used in articles intended for fabric covering of the interleaving material or shirtfront type. They give the product in which they are incorporated their firmness and strength The use of single-filament synthetic threads as reinforcing threads, in replacement for natural hair, is already known.

One of the problems which is posed is the appearance, notably during successive washings, of a slipping of these threads within the structure of the textile base in which they are incorporated.

The document EP-A-0 428 430 describes a reinforcing thread comprising a core thread and coating fibres which are glued around the core thread by means of an adhesive substance. The coating fibres then give relief to the thread, which enables it to be attached in the structure and therefore prevents it from slipping.

This technique has the drawback of providing, prior or subsequently to the association of the coating fibres on the core thread, a specific step of depositing an adhesive substance.

In addition, the association of a second type of coating fibre is made necessary to improve the feel of the reinforcing thread.

SUMMARY OF THE INVENTION

The invention therefore aims to remedy these drawbacks by proposing a method of manufacturing a reinforcing thread which makes provision for using the friction spinning method for associating, in a single step, coating fibres with a core thread, the said fibres then being able to be glued to the core thread by heating and the thread thus obtained having a satisfactory feel.

For this purpose, the invention proposes a method of manufacturing, by friction spinning, a reinforcing thread for fabric covering or technical textile intended to be incorporated in a textile base, in which:

the spinning machine is supplied with a core thread;

the spinning machine is simultaneously supplied with a sliver of fibres, the said fibres being individualised and then associated with the said core thread;

in which the sliver of fibres is formed by a mixture of hot-melt high melting/degradation point fiber.

The individualisation and association of the fibres on the core thread can be achieved by means of perforated spinning drums with strong air suction (the friction spinning process).

The core thread is formed by a single-filament thread or a multifilament thread.

According to one embodiment, the core thread also comprises a thread formed from discontinuous fibres which is associated or juxtaposed with the said single-filament or multifilament thread.

A step of heating the reinforcing thread to a temperature between the melting point of the hot-melt fibres and that of the high melting/degradation point fibers can be provided.

Other objects and advantages of the invention will emerge during the following description, given with reference to the accompanying drawings, in which:

DETAILED DESCRIPTION OF THE PREFERRED EMBODIMENTS

The reinforcing thread 1 includes a core thread 2 and coating fibres 3, 4 deposited around the said core thread 2 by a friction spinning technique.

For example, when the textile base is a woven fabric, the reinforcing thread 1 is woven, and when the textile base is a knitted fabric, the reinforcing threads 1 are incorporated in the system of stitches without participating in the formation thereof.

According to the intended use of the textile base, they can be introduced in the weft direction and/or in the warp direction.

Figure 2:
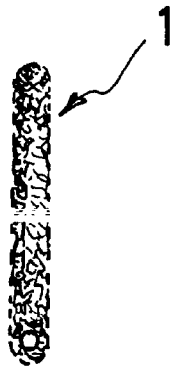
FIG. 2 depicts, in front view, a reinforcing thread obtained by implementing the method according to the invention, the said thread comprising a core thread formed by a single-filament thread and coating fibres associated with it.
Figure 3:
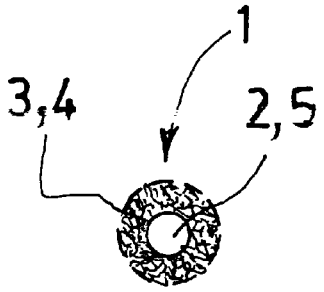
FIG. 3 is a view in section of the thread depicted in FIG. 2.

According to an embodiment depicted in FIGS. 2 and 3, the core thread 2 is formed by a thread 5 which is generally single-filament but which can also be multifilament.

The core thread 2 is produced from a synthetic or artificial material, such as, polymide, polyester or viscose. Artificial fibres are those fibres that are non-natural and are obtained through chemical procedures, the substances of which are rendered soluble and the solutions obtained, filtered through very small holes, are collected in a coagulation bath that coagulates the original substance under the form of more or less long threads.

Figure 4:
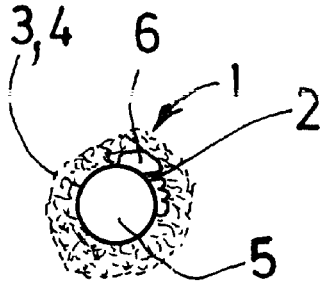
FIG. 4 depicts, in section, a reinforcing thread obtained by implementing the method according to a second embodiment of the invention, the said thread comprising a core thread formed by a single-filament thread and a fibre thread, and coating fibres associated with it.

In another embodiment depicted in FIG. 4, the core thread 2 also comprises a thread 6 formed by discontinuous fibres. The two threads 5, 6 are for example juxtaposed parallel to each other. In a variant, they can be associated, for example by winding or covering of the thread 6 formed from discontinuous fibres on the thread 5. The association or juxtaposition is carried out prior to the supplying of the spinning machine 7 with the core thread 2.

The function of the thread 6 formed by discontinuous fibres is to promote the attachment of the coating fibres 3, 4 to the core thread 2. The material forming the fibres of the thread 6 can be identical or different from that forming the thread 5.

The choice of the type of core thread 2 used is a function of the applications intended for the reinforcing thread 1. The core thread 2 is notably a high numbering thread, for example between 160 Dtex and 800 Dtex.

According to the invention, the coating fibres 3, 4 are formed by a mixture of hot-melt fibres 3 and high melting/degradation point fibers 4.

The term "high melting point fibres" is used to designate fibres which melt or degrade at a temperature higher than the melting point of the hot-melt fibres 3.

For example, the hot-melt fibres 3 have a melting point below 150° C., the melting point of the high melting/degradation point fibers 4 being higher than 180° C.

The hot-melt fibres 3 can be formed by copolymers, for example based on copolyamides or copolyesters. The high melting/degradation point fibers 4 can be synthetic, for example formed from polyamide or polyester, or artificial, for example formed from viscose, or natural, for example formed from cotton.

According to another embodiment, the hot-melt fibres 3 are dual-component fibres, for example of the CoPA/PA-6 type with a melting point of between 135° C. and 145° C.

The hot-melt fibres 3 and the high melting/degradation point fibers 4 generally have a numbering, identical or different, between 1 Dtex and 3.5 Dtex.

Figure 1:
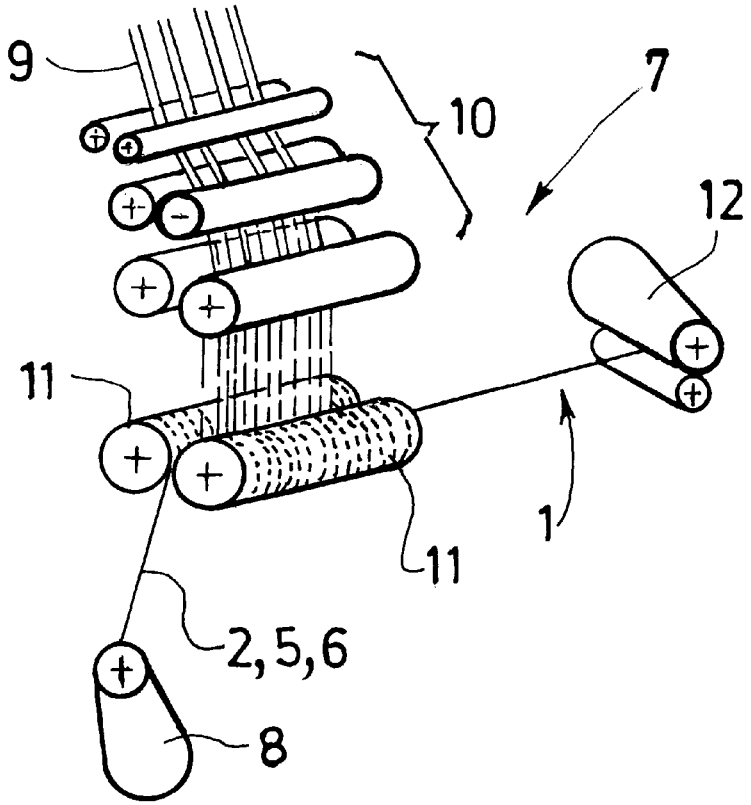
FIG. 1 depicts, schematically, a friction spinning machine which is supplied on the one hand with a core thread and on the other hand with a sliver of fibres formed by a mixture of hot-melt fibres and high melting/degradation point fibers; the said machine comprising perforated spinning drums for individualising and associating the said fibres on the core thread.

The hot-melt fibres 3 and the high melting/degradation point fibers 4 are disposed simultaneously on the core thread 2 by means of a friction spinning machine 7. The friction spinning technique is known per se but its characteristics which are essential for an understanding of the invention are set out below in relation to FIG. 1.

A reel 8 on which the core thread 2 has been wound is provided in order to be able to supply the spinning machine 7 with the said core thread 2 on a first path.

On a second path, a sliver 9 or ribbon formed from the mixture of hot-melt fibres and high melting/degradation point fibers 4 is fed into the spinning machine 7 by means of rollers 10. In the embodiment depicted in FIG. 1, the spinning machine 7 is fed with four identical slivers 9.

The preparation of the sliver 9 is carried out in a conventional fashion by working, carding and drawing of the fibres 3, 4 making it up. The hot-melt fibres 3 and the high melting/degradation point fibers 4 are then distributed uniformly in the sliver 9 so that they are disposed in a statistical fashion on the core thread 2.

The spinning machine 7 has perforated spinning drums 11 in which the two paths join so as to be supplied simultaneously with core thread 2 and coating fibres 3, 4.

The function of the drums 11 is, through their rotation, to individualise the fibres 3, 4 forming the sliver 9 and to dispose the said individualised fibres 3, 4 on the core thread 2.

The term "individualise" is used here to describe the state of the fibres 3, 4 in contradistinction to the fibres which have been subjected to twisting and constitute a thread or in contradistinction to long filaments.

At the discharge from the drums 11, the reinforcing thread 1 formed from the core thread 2 on which the hot-melt fibres 3 and the high melting point fibres 4 are disposed, is wound on a reel 12.

In a first variant embodiment, the reinforcing thread 1 is then heated to a temperature between the melting point of the hot-melt fibres 3 and that of the high melting/degradation point fibers 4.

This step, by melting the hot-melt fibres 3, provides a bonding of the high melting/degradation point fibers 4 to the core thread 2.

In addition, through an appropriate choice of the mixture of the materials forming the coating fibres 3, 4, the feel of the reinforcing thread 1 can be made satisfactory with a view to its application.

This is because, and unlike the thread described in the document EP-A-0 428 430, the coating fibres 3, 4 are already formed from two materials of different natures.

In a second variant embodiment, the reinforcing thread 1 is first of all incorporated in the textile base by conventional weaving or knitting techniques, and then the textile base is heated to a temperature between the melting point of the hot-melt fibres 3 and that of the high melting/degradation point fibers 4 so as to bond the high melting point fibres 4 to the core thread 2.

This variant is made possible by the fact that, prior to any heating, the coating fibres 3, 4 have characteristics of adhesion to the core thread 2 which are sufficient to enable the reinforcing thread 1 to be worked.

The function of the coating fibres 3, 4 is to give a relief to the reinforcing thread 1 which enables it to be attached in the structure.

To this end, they must be fixed to the core thread 2 in order to prevent any sliding of the reinforcing thread 1 in the structure, notably during successive washings of the textile base.

The reinforcing threads 1 have a diameter generally greater than ten hundredths of a millimeter and the core thread can have great rigidity.

In a preferred embodiment, the proportion of hot-melt fibres 3 in the sliver 9 is between 20% and 60% by weight.

This is because it turns out that 20% of hot-melt fibres 3 in the sliver 1 gives sufficient cohesion to the coating fibres 3, 4 on the core thread 2 to satisfy the average characteristics required.

However, according to the performance essential for resistance to maintenance treatment (washing, dry cleaning), it is preferable to increase the proportion of hot-melt fibres 3 in the sliver 9.

However, it turns out that more than 60% of hot-melt fibres 3 in the sliver 9 does not enable the method to be implemented satisfactorily.

This is because the preparation of the coating fibres 3, 4 in order to present them in parallel, in the form of a sliver 9, at the spinning frame, is then made practically impossible. This problem partly results from the lack of permanent curls on the coating fibres 3, 4 and the excessive flexibility of the hot-melt fibres 3.

An example of an embodiment of a reinforcing thread 1 according to the invention is given below, given by way of illustrative and non-limitative example.

The core thread 2 is formed from:

- a single-filament thread 5 of Polyamide 6-6—22/100 (430 Dtex); and
- a thread 6 formed from discontinuous viscose fibres of 1.7 Dtex cut 40 mm, the numbering of the thread being 250 Dtex.

The coating fibres 3, 4 are formed from a mixture of:

40% fibres 3 made from hot-melt copolyamides of 2.2 Dtex cut 43 mm;

60% fibre 4 made from viscose of 1.7 Dtex cut 38 mm.

The reinforcing thread 1 thus obtained has a numbering of 970 Dtex, including 44% single-filament thread 5, 26% thread 6 formed from discontinuous fibres and 30% coating fibres 3, 4.

What is claimed is:

1. Method of manufacturing, by friction spinning, a reinforcing thread (1) for fabric covering or technical textile intended to be incorporated into a textile base in which:

the spinning machine (7) is supplied with a core thread (2) and is simultaneously supplied with a sliver (9) of fibres (3, 4), the said fibres (3, 4) being individualised and then associated with the said core thread (2); and the said method being characterised in that the sliver (9) of fibres is formed from a mixture of hot-melt fibres (3) and high melting point fibres (4), where the hot-melt fibres (3) are formed from copolymers.

2. Method according to claim 1, characterised in that individualisation and association of the fibres (3, 4) on the core thread (2) are effected by means of perforated spinning drums (11) with strong air suction.

3. Method according to claim 1, characterised in that the proportion of hot-melt fibres (3) in the silver (9) is between 20% and 60% by weight.

4. Method according to claim 1, characterised in that the hot-melt fibres (3) have a melting point below 150° C., the melting point of the high melting point fibres (4) being above 180° C.

5. Method according to claim 1, characterised in that the high melting point fibres (4) are synthetic.

6. Method according to claim 1, characterised in that the high melting point fibres (4) are artificial.

7. Method according to claim 1, characterised in that the high melting point fibres (4) are natural.

8. Method according to claim 1, characterised in that the core thread (2) is formed from a single filament thread (5).

9. Method according to claim 8, characterised in that the core thread (2) also comprises a thread (6) formed from discontinuous fibres which is associated or juxtaposed with the said single-filament or multifilament thread (5).

10. Method according to claim 1, characterised in that the core thread (2) is formed from a multifilament thread (5).

11. Method according to claim 1, characterised in that the core thread (2) is synthetic.

12. Method according to claim 1, characterised in that the core thread (2) is artificial.

13. Method according to claim 1, characterised in that the method comprises a-step of heating the reinforcing thread (1) to a temperature between the melting point of the hot-melt fibres (3) and that of the high melting point fibres (4).

14. Method of manufacturing, by friction spinning, a reinforcing thread (1) for fabric covering or technical textile intended to be incorporated into a textile base in which:

the spinning machine (7) is supplied with a core thread (2) and is simultaneously supplied with a sliver (9) of fibres (3, 4), the said fibres (3, 4) being individualised and then associated with the said core thread (2); and the said method being characterised in that the sliver (9) of fibres is formed from a mixture of hot-melt fibres (3) and high melting point fibres (4), where the hot-melt fibres (3) are dual-component fibres.

15. Method according to claim 14, characterised in that individualisation and association of the fibres (3, 4) on the core thread (2) are effected by means of perforated spinning drums (11) with strong air suction.

16. Method according to claim 14, characterised in that the proportion of hot-melt fibres (3) in the silver (9) is between 20% and 60% by weight.

17. Method according to claim 14, characterised in that the hot-melt fibres (3) have a melting point below 150° C., the melting point of the high melting point fibres (4) being above 180° C.

18. Method according to claim 14, characterised in that the high melting point fibres (4) are synthetic.

19. Method according to claim 14, characterised in that the high melting point fibres (4) are artificial.

20. Method according to claim 14, characterised in that the high melting point fibres (4) are natural.

21. Method according to claim 14, characterised in that the core thread (2) is formed from a single filament thread (5).

22. Method according to claim 21, characterised in that the core thread (2) also comprises a thread (6) formed from discontinuous fibres which is associated or juxtaposed with the said single-filament or multifilament thread (5).

23. Method according to claim 14, characterised in that the core thread (2) is formed from a multifilament thread (5).

24. Method according to claim 14, characterised in that the core thread (2) is synthetic.

25. Method according to claim 14, characterised in that the core thread (2) is artificial.

26. Method according to claim 14, characterised in that the method comprises a step of heating the reinforcing thread (1) to a temperature between the melting point of the hot-melt fibres (3) and that of the high melting point fibres (4).

* * * * *